US006253448B1

(12) United States Patent
Zieve et al.

(10) Patent No.: US 6,253,448 B1
(45) Date of Patent: Jul. 3, 2001

(54) GRIPPER SYSTEMS FOR RIVETS AND COLLARS USED IN LARGE-SCALE ASSEMBLY OPERATIONS

(75) Inventors: Peter B. Zieve, Seattle; Carter L. Boad, Lynnwood; Sam O. Smith, Woodinville; Scott E. Neel; Brent W. Huffer, both of Everett, all of WA (US)

(73) Assignee: Electroimpact, Inc., Mukilteo, WA (US)

( * ) Notice: Subject to any disclaimer, the term of this patent is extended or adjusted under 35 U.S.C. 154(b) by 0 days.

(21) Appl. No.: 09/275,352

(22) Filed: Mar. 23, 1999

(51) Int. Cl.[7] ..... B23P 21/00

(52) U.S. Cl. ..... 29/709; 29/715; 29/525.06; 29/524.1; 29/243.53; 227/119; 227/51

(58) Field of Search ..... 29/243, 525, 243.526, 29/243.527, 243.528, 243.529, 407.01, 707, 715, 788, 524.1, 525.06, 243.53, 283; 227/119, 51, 101, 147; 72/391

(56) References Cited

U.S. PATENT DOCUMENTS 3,832,880 * 9/1974 Charman .
3,939,992 * 2/1976 Mikule .
4,566,182 * 1/1986 Altwicker .
4,609,134 9/1986 Davern .
4,747,294 * 5/1988 Schwartz et al. .
4,819,856 4/1989 Davern et al. .
5,142,774 9/1992 Jeffrey .
5,287,611 * 2/1994 Muselli .
5,437,094 8/1995 Zieve et al. .
5,452,505 * 9/1995 gasser .
5,519,932 * 5/1996 Kuze .
5,598,619 2/1997 Rosier .
5,647,583 * 7/1997 Emigh .
5,655,289 * 8/1997 Wille et al. .
5,727,300 3/1998 Ekdahl et al. .

* cited by examiner

*Primary Examiner*—S. Thomas Hughes
*Assistant Examiner*—Steven Blount

(57) ABSTRACT

The system includes means for moving a rivet or a collar from a storage bin to an initial position for the respective gripping assemblies. The presence of the rivet and/or collar is recognized as it moves through a feeding mechanism. After the rivet or collar is gripped, they are moved either into an opening in the workpiece, in the case of a rivet, or onto the tail of a lockbolt, in the case of a collar. The gripping assembly is then released from the rivet or the collar, with the gripping means moving back to an initial position. Further operations can then be carried out on the rivet or collar.

16 Claims, 13 Drawing Sheets

GRIPPER SYSTEMS FOR RIVETS AND COLLARS USED IN LARGE-SCALE ASSEMBLY OPERATIONS

TECHNICAL FIELD

This invention relates generally to automatic riveting systems, and more particularly concerns both a rivet gripping assembly which moves a rivet into an opening in a workpiece and a collar gripping assembly which moves a collar onto the tail end of a lockbolt which extends through an opening in a workpiece.

BACKGROUND OF THE INVENTION

In the manufacture of large structural assemblies, such as for instance aircraft wings, sheets of material, such as aluminum, are fastened together with rivets and/or lockbolt/collars. Rivets are a one-piece fastener, generally have a pin-like body, with a head on one end, and are generally ⅛ to ½ inch in diameter. In the fastening operation, rivets are inserted into openings which are drilled through the two or more pieces of material (the workpiece) which are to be secured together. The rivet is then upset, using conventional techniques. Prior to insertion of the rivet in the workpiece opening, the rivet is moved from a local storage bin to a gripping element, which typically comprises one or more passive, finger-like elements which are typically part of a ram assembly which inserts the rivet in the opening in the workpiece.

Once the rivet is inserted into the opening in the workpiece, the ram elements on opposite sides of the workpiece are moved into contact with the rivet; great force is then applied against the rivet by the ram, causing upset of the rivet and producing an interference fit with the workpiece. A secure attachment of the material pieces comprising the workpiece results. While rivets come in several different sizes and configurations, the basic installation procedure and the result is the same.

The lockbolt/collar fastening system, on the other hand, is a two-part fastener, combining a lockbolt with a head portion and a pin body having threads on the free end (tail), with a mating collar. The pin tail of the lockbolt is inserted through an opening in the workpiece and the collar is then swaged onto the extending tail of the bolt. Prior to swaging, a collar is moved from local storage to a gripping assembly comprising passive fingers, similar to that for the rivets. In swaging, a ram squeezes on the collar and compresses it tightly over the threads on the pin tail portion of the lockbolt. The combination of the lockbolt and the swaged collar holds the workpiece elements securely together.

In prior art machines used for large-scale assembly operations, spring-loaded, passive fingers are used to hold rivets and/or collars while they are moved to the point of use at the workpiece. The rivet is typically either forced onto the spring-loaded fingers from the back side by means of compressed air or pressed onto the front of the fingers. The rivet then is carried into the hole on the fingers. As the rivet ram pushes the rivet into the opening, the fingers slide back away from the rivet, exposing the rivet for action of the ram in its upset action on the rivet.

In one particular arrangement, the spring-loaded fingers are mounted on the ram and slide along the ram itself. In this arrangement, an inserter device is used to position the rivet onto the finger elements. In another arrangement, the ram itself pushes the rivet partially through the spaced spring-loaded fingers which in turn center the rivet in the opening in the workpiece. The fingers separate from the rivet in both cases by the forcible action of the ram moving the rivet into the opening. However, there is no positive control in gripping and/or releasing the rivet with existing finger arrangements. Instead, the action is passive, with the rivet being moved onto the fingers and then stripped off the fingers. The fingers are not positively controlled.

With such an arrangement, the rivet can become slightly misadjusted and cause damage to the workpiece as the rivet is inserted into the opening. Further, with such an arrangement, there is no opportunity for definitive confirmation that the rivet is of the proper size and configuration, and still further, whether or not there is even a rivet at all present on the fingers to be inserted.

Similarly, prior art collar gripping arrangements also include spring-loaded fingers on which the collar is positioned. Such collar positioning systems also typically use a centering pin, as shown in U.S. Pat. No. 5,437,094, which includes an O-ring arrangement. An enhancement of such an arrangement includes the use of a split metal ball instead of the O-ring. Generally, however, in all these collar-insertion systems, the collar must be stripped away from the spring fingers. Like the rivet fingers, there is no positive control over the action of the fingers and hence no positive control over positioning of the rivet or collar relative to the fingers. In both cases, the collar must be forcibly removed from the fingers. Separate powered devices must be used to move the rivet/collar onto the fingers and to remove the rivet/collar therefrom. Such a collar holding arrangement results in placement accuracy problems and a lack of required precision in reliably placing the collar on the exposed end of the lockbolt tail. In some cases, improper swaging of the collar results.

While relatively few errors generally occur with these prior systems, the errors which do occur are no longer satisfactory; higher standards of accuracy and performance are being implemented. Furthermore, errors produced by prior systems for holding rivets and lockbolts have occasionally resulted in damage to the workpiece, which is unacceptable.

It is desirable that gripping systems for rivets and collars used in large-scale assembly operations be fast, efficient and extremely reliable, resulting in very few, ideally no, errors. Preferably, it would be desirable that such a system have the capability of positively identifying the presence of a collar or rivet in the respective gripping systems, and further, that the rivet is the correct size and configuration for the particular opening in the workpiece.

DISCLOSURE OF THE INVENTION

Accordingly, the present invention includes a system for gripping a rivet element during installation thereof in an assembly, comprising: means for moving a rivet from a storage location to an initial operating position, means for gripping the rivet when it is in its initial position in response to a signal command, the gripping means in operation moving from a first position which is relatively away from the rivet to a second, closed position positively gripping the rivet; means for moving the gripped rivet into an opening in an assembly workpiece; and means for releasing the gripping means from the rivet, the gripping means moving back to its first position, so that the rivet can be upset.

The present invention also includes a system for gripping a collar element which is to be swaged onto a bolt in assembly operations, comprising: means for moving a collar from a storage location to a gripper member prior to the collar being inserted onto a tail portion of a bolt element, the gripper member including means for closing upon and positively gripping a collar element, in response to a signal command; means for moving the gripper member from an initial position following gripping of the collar element, such that the collar is moved onto the tail portion of the bolt; means for releasing the collar from the gripper member following moving of the collar onto the bolt; and means for moving the gripper member back to its original position.

BEST MODE FOR CARRYING OUT THE INVENTION

Figure 1:
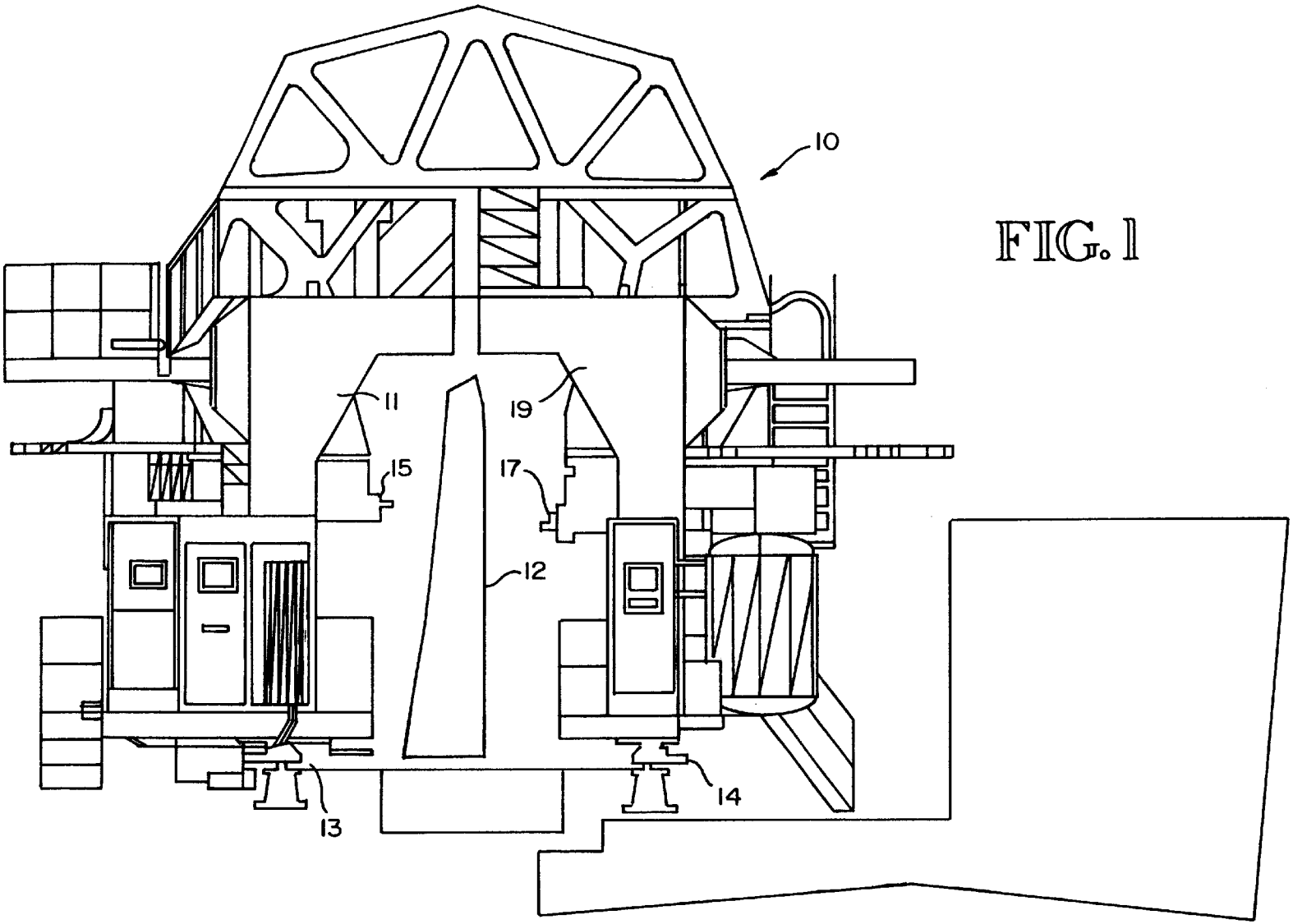
FIG. 1 shows a complete large-scale assembly system which uses the rivet and collar gripping systems of the present invention.

FIG. 1 shows a large yoke assembly 10. Yoke assembly 10 is used for large-scale assembly operations, such as fastening together the various sheets and structural members which comprise a wing panel of large commercial aircraft. An example of such a wing panel is 8 ft. high (the wing is positioned on its edge) and 50 ft. long, shown generally at 12 in FIG. 1. Yoke assembly 10 extends down both sides of the wing panel and up over the top thereof. Wing panel 12 is typically supported in a fixture (jig) of some kind (not shown) while yoke assembly 10 is mounted on extended floor track assemblies, shown generally at 13 and 14, along the length of the wing. Yoke assembly 10 in effect straddles the assembly.

Positioned on opposing legs of yoke assembly 10 are two pressure assembly heads which each include sets of tools which accomplish the fastening operations. The pressure assembly heads move toward each other under computer (microprocessor) command to squeeze or clamp the wing in the vicinity of the immediate fastening operation to be accomplished. This pressure operation, referred to as clamp-up, is conventional and is therefore not described in detail. Clamp-up operations are described in other patents owned by the assignee, including U.S. Pat. Nos. 5,033,174 and 5,699,599, both of which are directed toward yoke-type assembly operations.

Each of the clamp-up assemblies in the embodiment shown move into opposing ends of a riveting axis, along which the fastening operations occur. The tools for accomplishing the fastening operations are located in apertures in the clamp-up assemblies, and are shown generally in FIG. 1 at 15 and 17. One of the tool sets, mounted on leg 11 of the yoke, includes an electromagnetic riveting apparatus (EMR), including one ram portion thereof, which accomplishes the upset of the rivet after it has been inserted in an opening in the workpiece being assembled.

Other tools at this location include an apparatus for drilling the hole in the workpiece for the rivet as well as the rivet gripping system of the present invention. The rivet feeding system for moving a rivet from a storage location to the first gripping system is not shown in FIG. 1, but is shown in other figures herein. The electromagnetic riveting assembly (EMR) and the hole drilling apparatus are conventional and thus not described in detail. An electromagnetic riveter suitable for use in the yoke system herein is shown in U.S. Pat. No. 4,862,043, owned by the assignee of the present invention.

Mounted to the other leg 19 of yoke assembly 10, besides the collar positioning and swaging system 17, is the other ram element (not shown) of the electromagnetic riveting system. The collar gripping system of the present invention is part of the collar positioning and swaging system 17.

The structure of FIG. 1 is intended to show a representative assembly system with which the separate gripping systems for rivets and collars of the present invention can be effectively used. It should be understood, however, that the gripping systems of the present invention disclosed in detail hereinafter can be used with other assembly systems.

Figure 2A:
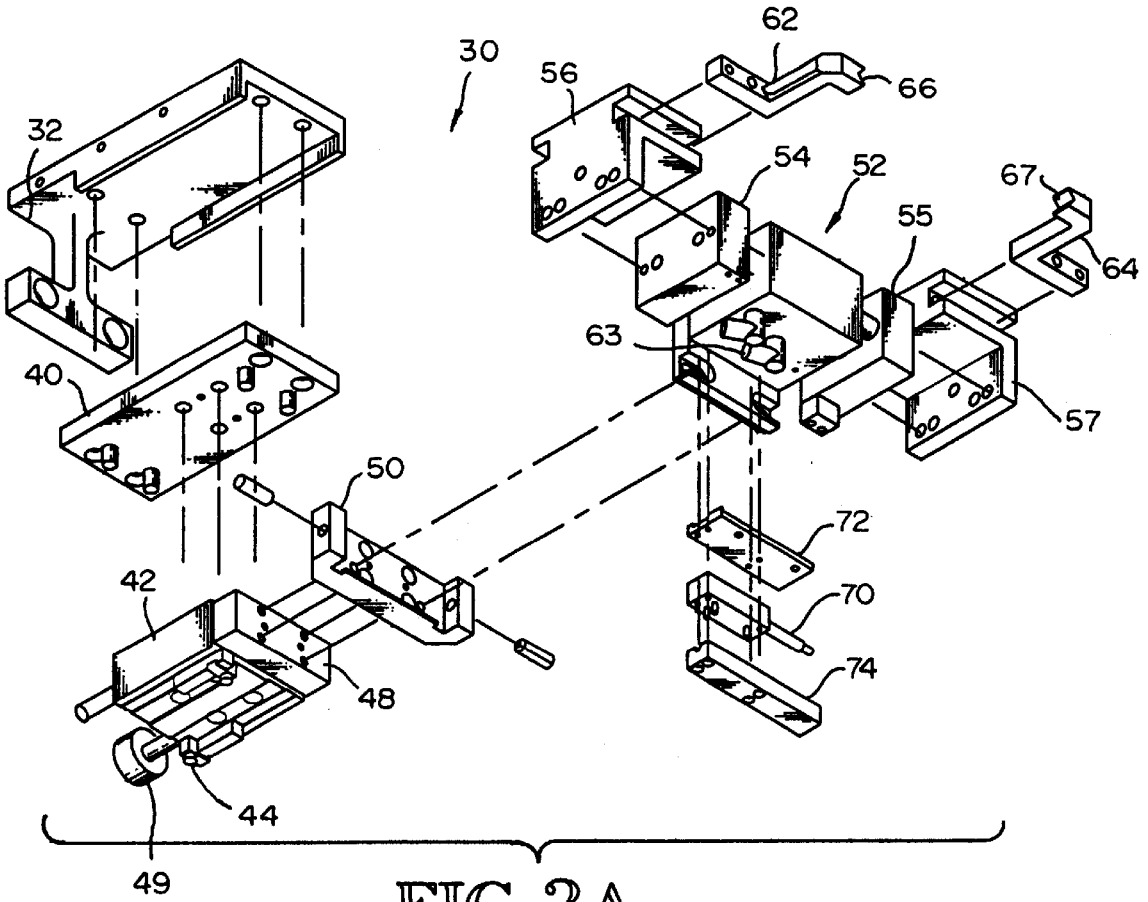
FIGS. 2A and 2B show exploded and assembled views of the rivet gripping system of the present invention.
Figure 2B:
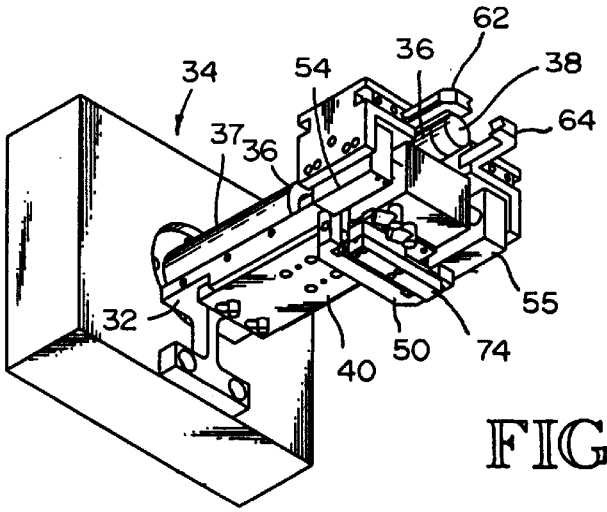

FIGS. 2A and 2B show the rivet gripping system of the present invention in detail, both exploded and assembled. The rivet gripping assembly, shown generally at 30, is secured by means of a steel mounting plate 32 to the electromagnetic riveting apparatus, shown generally at 34. The electromagnetic riveter (EMR) includes an extending ram element 36 in a bearing 37, on the end of which ram element is a cup-like die member 38. The exposed face of the die element 38 is concave, configured to receive the head end of a rivet.

Secured to the lower surface of mounting plate 32 is a compliant tilting plate 40. Mounted to the lower surface of tilting plate 40 is a linear slider member 42. Linear slider member 42 is capable of moving forward and back relative to tilting plate 40. Mounted on slider member 42 is a proximity switch or Hall effect switch 44. The purpose of this switch is to detect closing of the gap between die element 38 and a rivet, as explained in more detail below.

The front end portion 48 of slider member 42 moves toward and away from slider member 42 on mounting rods by means of compressed air. A stop 49 limits the forward travel of front end 48. Adjusting member 50 is mounted to front end portion 48, to which is mounted at the front end thereof a robotic actuator 52. The robotic actuator 52 includes spaced actuator pads 54 and 55, positioned on mounting rods. The actuator pads move in and out on the mounting rods by compressed air. Mounted to the actuator pads 54 and 55 are finger mounting members 56 and 57, in the front face of which are horizontal grooves 58 and 59 in which are mounted rivet gripping fingers 62 and 64. Rivet gripping fingers 62 and 64 extend initially directly forwardly of finger mounting members 56 and 57, and then inwardly directly toward each other, each terminating in notched free ends 66 and 67.

In basic operation, the rivet gripping assembly 30 can move forwardly and rearwardly (toward and away from the wing assembly in FIG. 1) by means of the front end portion 48 of slider member 42. Slider member 42 includes an air actuator which is controlled by control signals from a system microprocessor. The individual gripping fingers 62 and 64 are capable of moving toward and away from each other in a horizontal plane by actuator pads 54 and 55, which are moved by compressed air and actuator means in robotic actuator 52. Connections for the compressed air are shown at 63. Air in one connection results in pads 54 and 55 moving inwardly (and hence gripping fingers 62 and 64) while air at the other connection results in the two pads moving outwardly, away from each other. The control of robotic actuator 52 is accomplished by control signals generated at selected times by a microprocessor as a result of a stored software program.

Other structural features of the gripping assembly of FIGS. 2A and 2B will be discussed in detail below relative to the sequence of operations of the assembly. The remaining elements in FIGS. 2A and 2B include in general a linear potentiometer 70, a mounting plate 72 for the potentiometer and a potentiometer cover 74. Linear potentiometer 70, discussed in more detail below, is used to determine the presence and size of the rivet which is fed to the gripping assembly. An alternative to potentiometer 70 is an LVDT.

Figure 3:
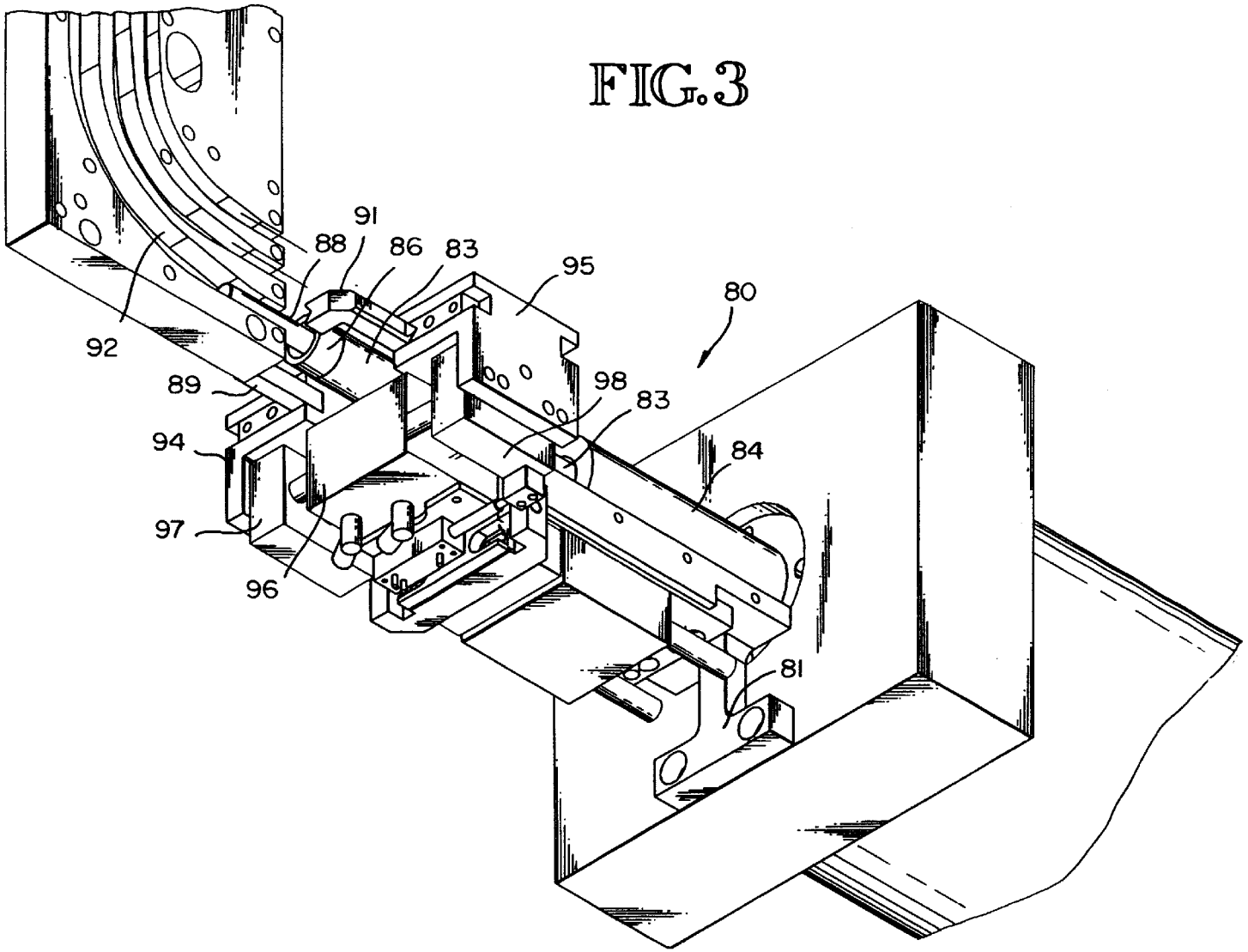
FIGS. 3–9 are perspective views of the sequence of operational steps for the rivet gripping system of the present invention.

FIGS. 3–9 show the sequence of operations for the rivet gripping system of the present invention. FIG. 3 shows the rivet gripping system generally at 80, the same as shown in FIGS. 2A and 2B. Rivet gripping system 80 is secured to the electromagnetic riveting system, shown generally at 82, by means of mounting member 81. EMR system 82 includes a ram mechanism 83 which accomplishes the upset of the rivet when the rivet is properly positioned in the opening of the workpiece. Ram 83 is shown in a bearing 84. At the very front end of ram 83 is the cup-like die 86 which is configured to receive a head portion of a rivet 88.

At the start of the gripping action, the rivet gripping system 80, part of the EMR 82, is positioned relative to a rivet feed system 90, so that a rivet can be fed into the rivet gripping system 80. A portion of the rivet feed system 90 is shown in FIG. 3. The rivet feed system 90 includes several feed channels through which rivets move from a nearby storage bin (not shown) by means of compressed air. In operation, a rivet 88 is moved at high speed by means of compressed air through channel 92 in the embodiment shown. The head end of rivet 88 moves into die 86 as shown, contacting the inner rear surface thereof. At this point, gripping fingers 89 and 91 are in a first position, away from the rivet 88.

On its way along channel 92, the rivet passes a magnetic ring sensor (not shown). The ring sensor sends a signal to the system microprocessor, which begins to time-out for a short span of time, i.e. approximately 150 milliseconds. At the end of this time, the microprocessor sends out an electrical control signal to the robotic actuator 96. compressed air from a source thereof is directed to an air actuator in the robotic-actuator 96, which actuates the actuator pads 97 and 98, moving them and the gripper fingers 89 and 91 in finger mounts 94, 95 toward each other, resulting in the rivet being positively and firmly clamped between the opposing gripper fingers. The gripper fingers thus close up on the rivet from a position away from the rivet, under positive control.

Figure 4:
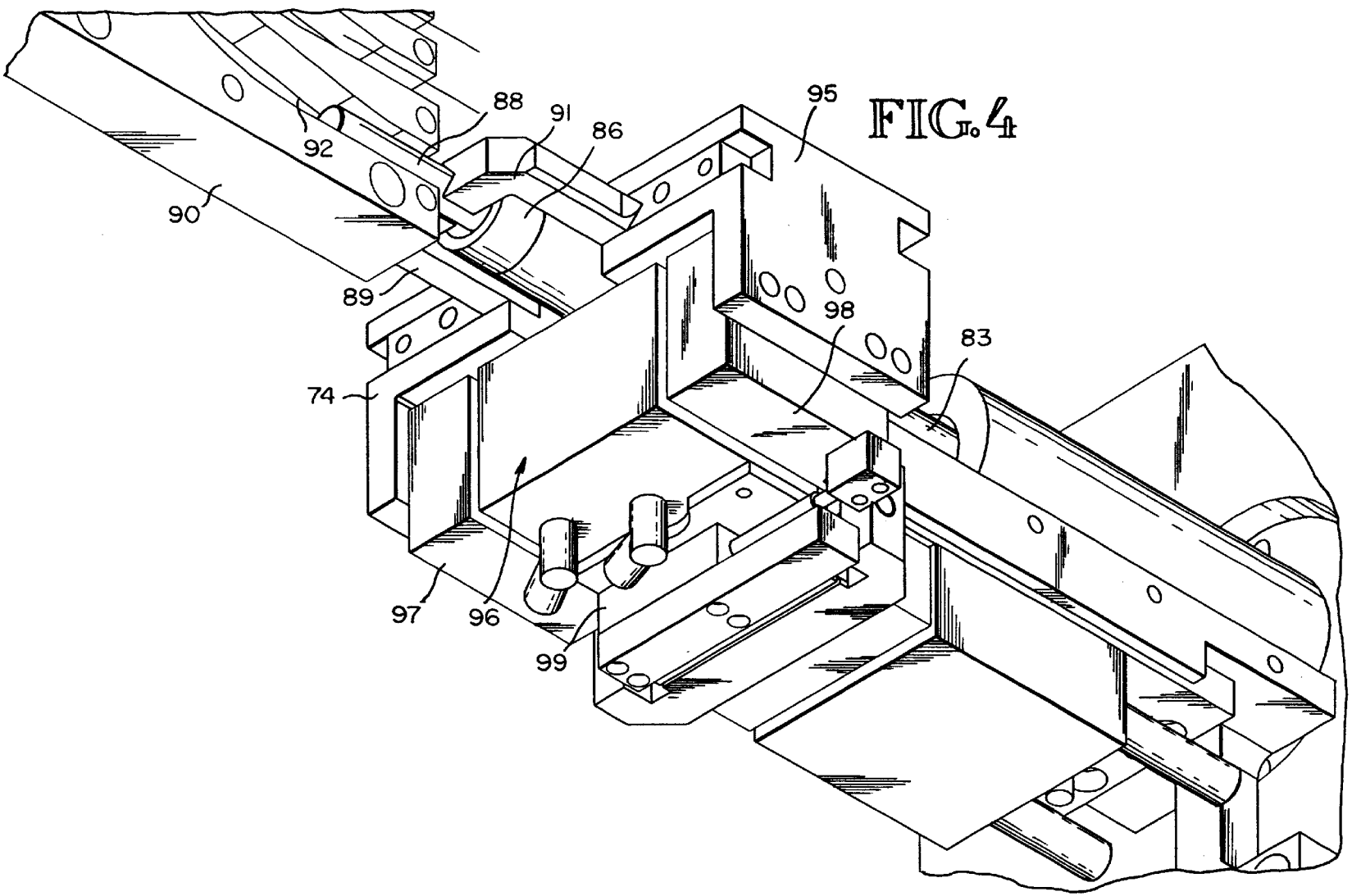

The notch in the free end of each of the respective gripper fingers results in a more consistent, reliable and controllable gripping action. At this point in the sequence, the rivet 88 is firmly and positively gripped, positioned in the cup-like die, against the rear interior surface thereof. This point in the sequence is shown in FIG. 4.

When the gripping fingers 89 and 91 close upon the rivet, as actuator pads 97 and 98 move toward each other, linear potentiometer 99 measures the diameter of the rivet, because of the distance moved by the two actuator pads 97 and 98 toward each other. If for some reason there is no rivet between the fingers, such as a failure of the rivet feed system, the fingers 89, 91 will overdose, with the potentiometer 70 indicating that fact. Further, if the rivet diameter is too large or too small, or if the rivet is not positioned exactly straight between gripping fingers 89, 91, the potentiometer 70 will indicate an error and the rivet is rejected. This rivet rejection system is important, since it prevents the EMR device from attempting to press an incorrectly sized or oriented rivet into the opening in the workpiece, which would result in damage to the workpiece.

Once an incorrectly sized or oriented rivet is detected by potentiometer 70, the rivet is simply dropped by releasing the gripper fingers, such that the fingers move to their open position, and a new rivet is fed to the gripping assembly. Alternatively, the fastening operation can be temporarily stopped, with the operator inspecting the position and size of the rivet in the gripping assembly to ascertain the error.

Figure 5:
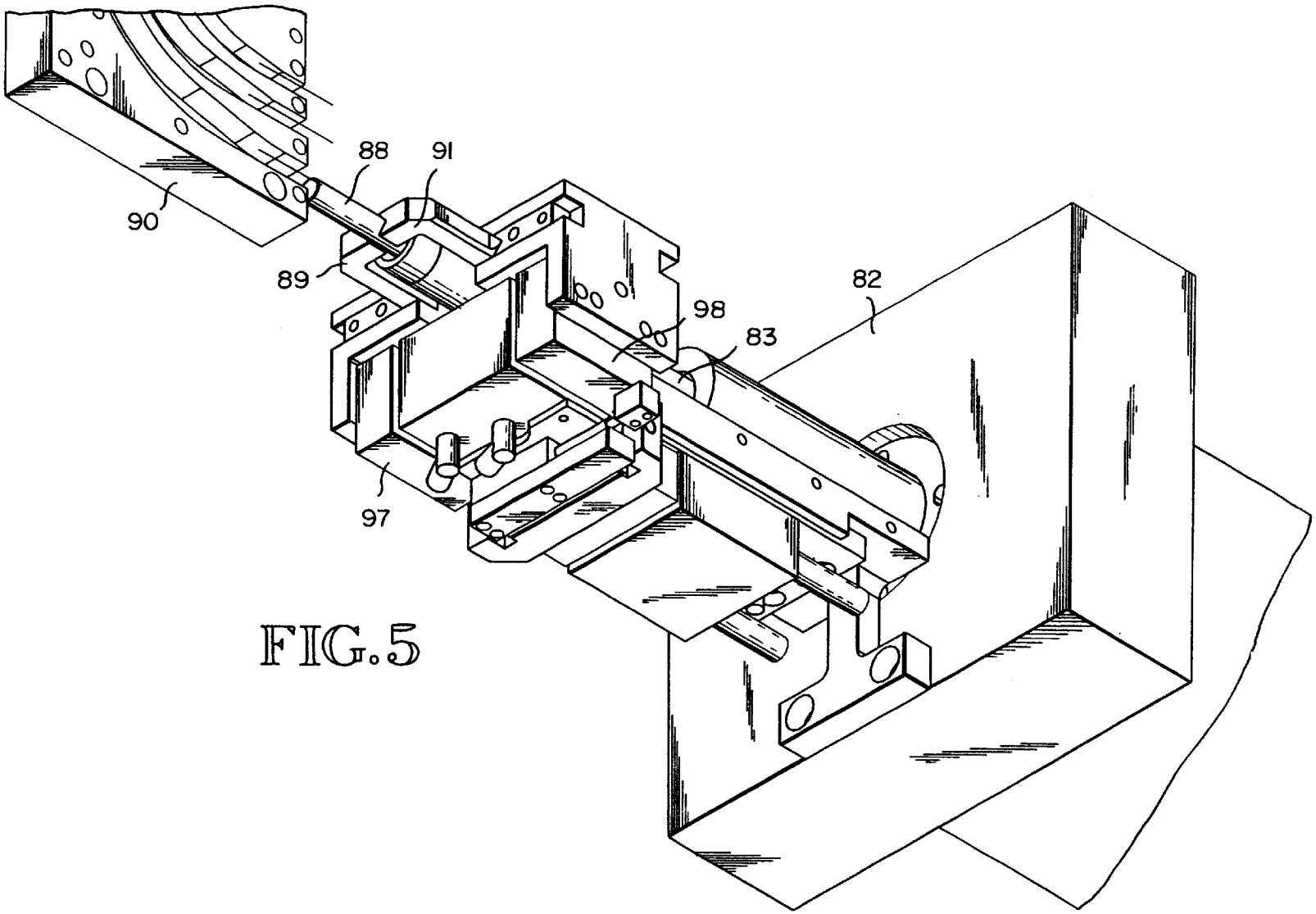

FIG. 5 shows the next step in the process, in which EMR 82, along with the rivet gripping system, is moved rearwardly, away from the feed system. At the end of this step, rivet 88 is free of the rivet feed system 90. In the embodiment shown, this is a distance of approximately 1½ inches. In the next step, shown in FIG. 6, the rivet feed assembly 90 is moved upwardly and out of the way of the rivet gripping system. In the embodiment shown, the distance is approximately 5 inches.

Figure 6:
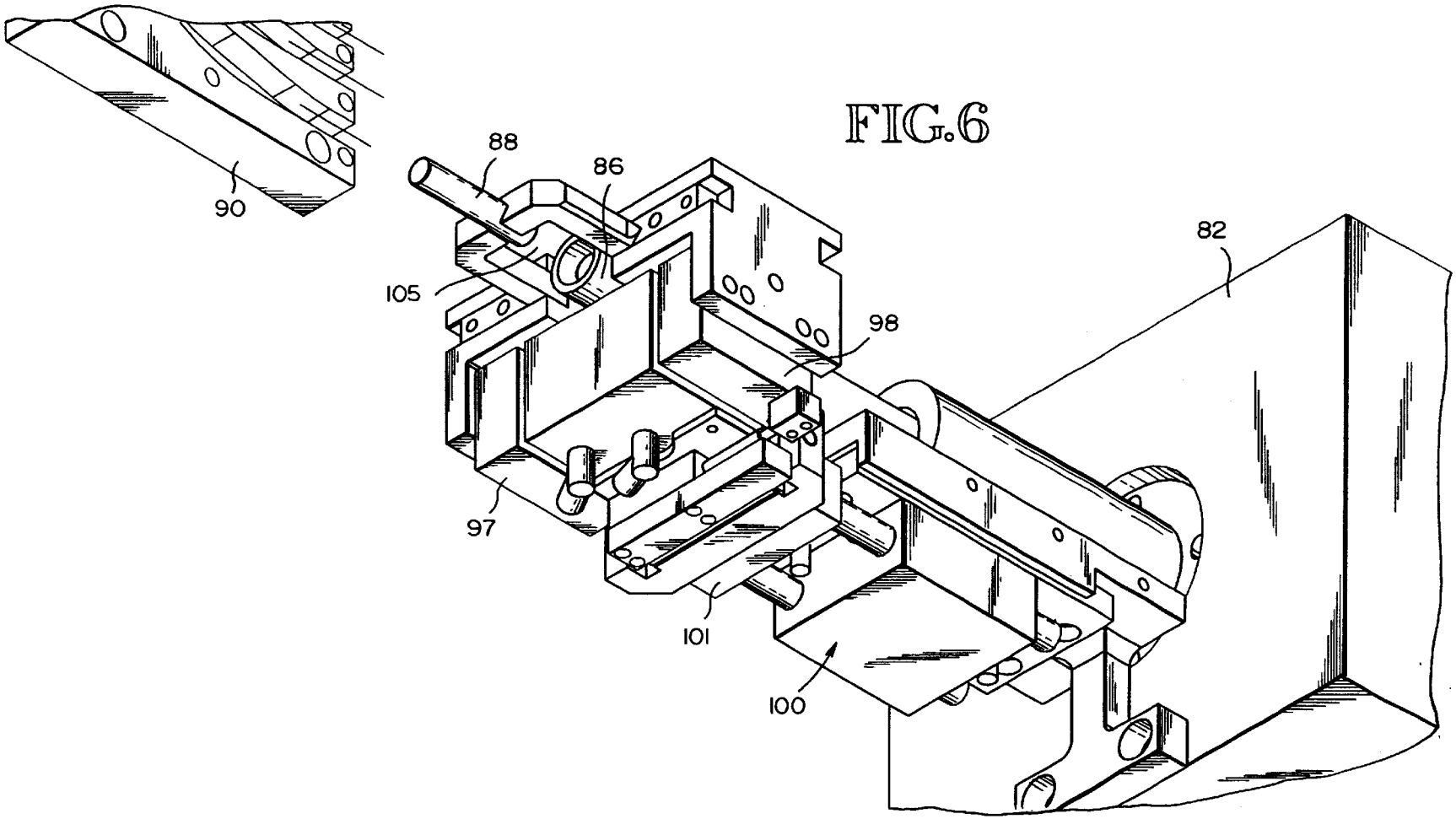

Following the movement of the rivet feed system 90 upwardly and hence out of the way of the rivet gripping system, the rivet gripping system is moved forwardly toward the workpiece 104 by slider member 100, in particular the front portion 101 thereof, a distance of approximately. 1 inch in the embodiment shown, such that there results a gap 105 between the head end of rivet 88 and the inner surface of the cup-like die 86. This gap 105 is shown in FIG. 6 and is approximately 1 inch in the embodiment shown. At this point, referring to FIG. 7, rivet ram 83 is on an axis with a previously drilled opening 103 (shown chamfered) in workpiece 104. As briefly explained above, a drill tool drills an opening of specified size under automatic computer control. The EMR device is controlled so that the rivet is on the axis of the opening, and also in the axis of the EMR ram 83, with a gap between the rivet and the die at the end of the ram. While the gap is advantageous, as explained below, it is not essential that there be an initial gap between the rivet and the cup-like die.

Slider member 100 is equipped with forward and back indicator switches (44 in FIG. 2A) which provide information on the direction of and amount of forward/rearward movement of the gripping assembly to the microprocessor. Thus, the microprocessor knows whether the fingers 89 and 91 are in a forward position, where the rivet 88 is away from die 86, or that the fingers are in a rear position, where the rivet is in contact with the die.

Figure 7:
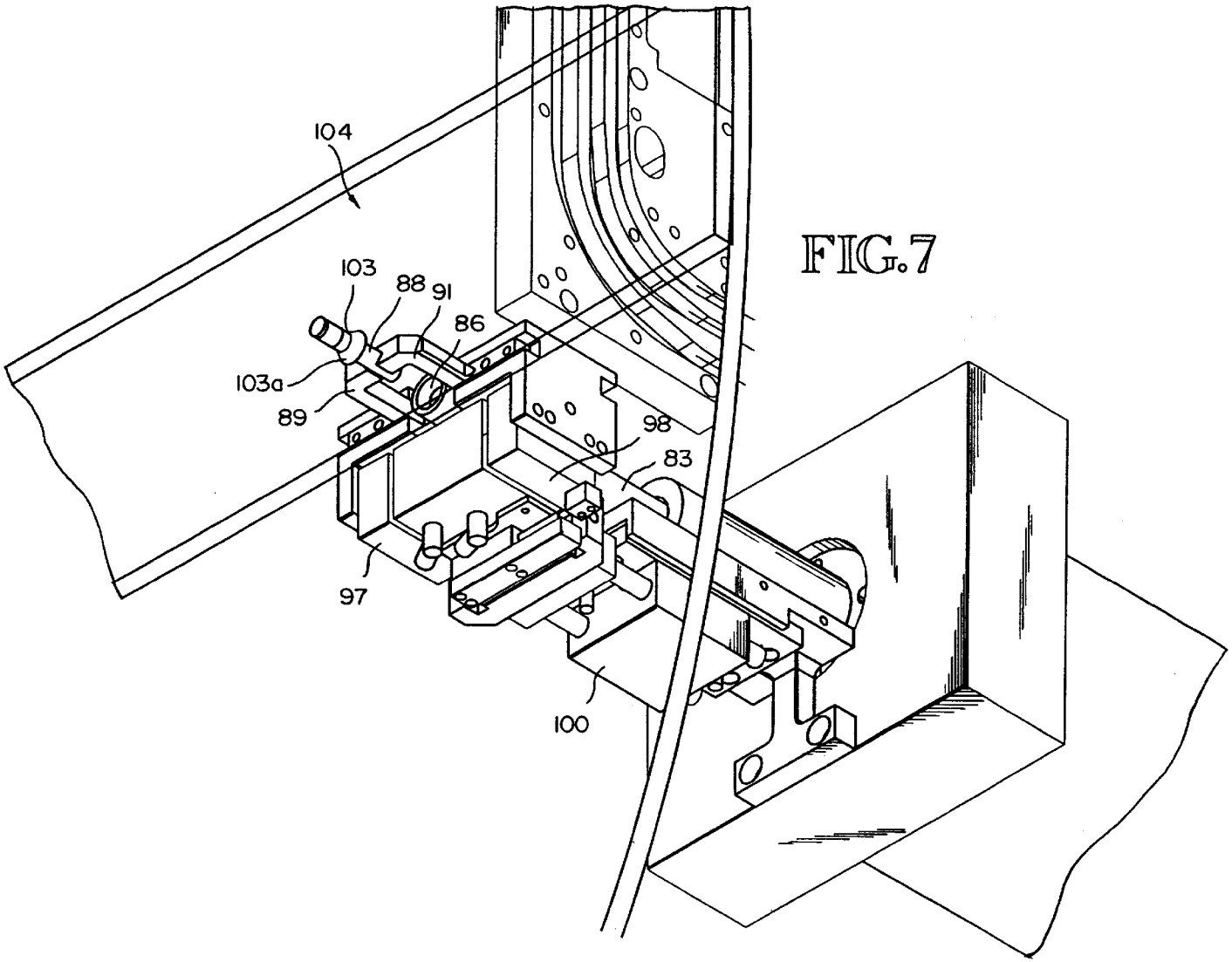

In FIG. 7, the EMR has moved the rivet into the drilled opening 103. As explained above, the rivet gripping assembly is mounted on a compliant mount 40 (FIG. 2A). Rivet 88 typically has a small chamfer at its free end, and the drill hole opening is often also chamfered as shown at 103*a* in FIG. 7. The compliant mount 40 allows the rivet 88 to self-align to some extent with the opening in the workpiece. The air gap 105 permits rivet 88 to even more readily self-align with the opening 103. The air gap 105 has other advantages relative to insertion of the rivet into the opening 103.

The drilled opening 103 in the workpiece is typically several thousandths of an inch larger in diameter than the rivet, so that the rivet will move into the opening with a minimum of pressure if everything is in order. However, sometimes a burr from the drilling will partially block the opening, and the rivet will not be able to readily slide in. Also, the opening may not be completed in a particular case, so that opening is blocked at the bottom thereof. This may be due to the drill bit being slightly too short or an incorrect drilling depth. Both of these situations, as well as others, can result in damage to the workpiece during the attempted insertion of the rivet into the opening.

The rivet ram will now move forwardly with the gripping assembly. The rivet will slide into the opening in the workpiece. The microprocessor (with proximity information from switches 44) keeps track of the position of the rivet as it moves forwardly along with the gripping assembly. If the ram moves sufficiently forwardly that the rivet should be fully inserted but the gap between the rivet and the die at the end of the ram has closed due to insertion resistance, i.e. the ram has moved fully forwardly but the rivet and the supporting portion of the gripper assembly has not, the rivet gripping fingers 89, 91 will not be opened, and the ram will be backed away from the workpiece with the rivet. The rivet will then be rejected and replaced by another rivet. An alarm can be provided indicating that the workpiece should be inspected. This arrangement accommodates for the hole being not fully or properly drilled, for a defect in the rivet or the wrong size rivet, and for substantial misalignment between the rivet and the opening.

Figure 8:
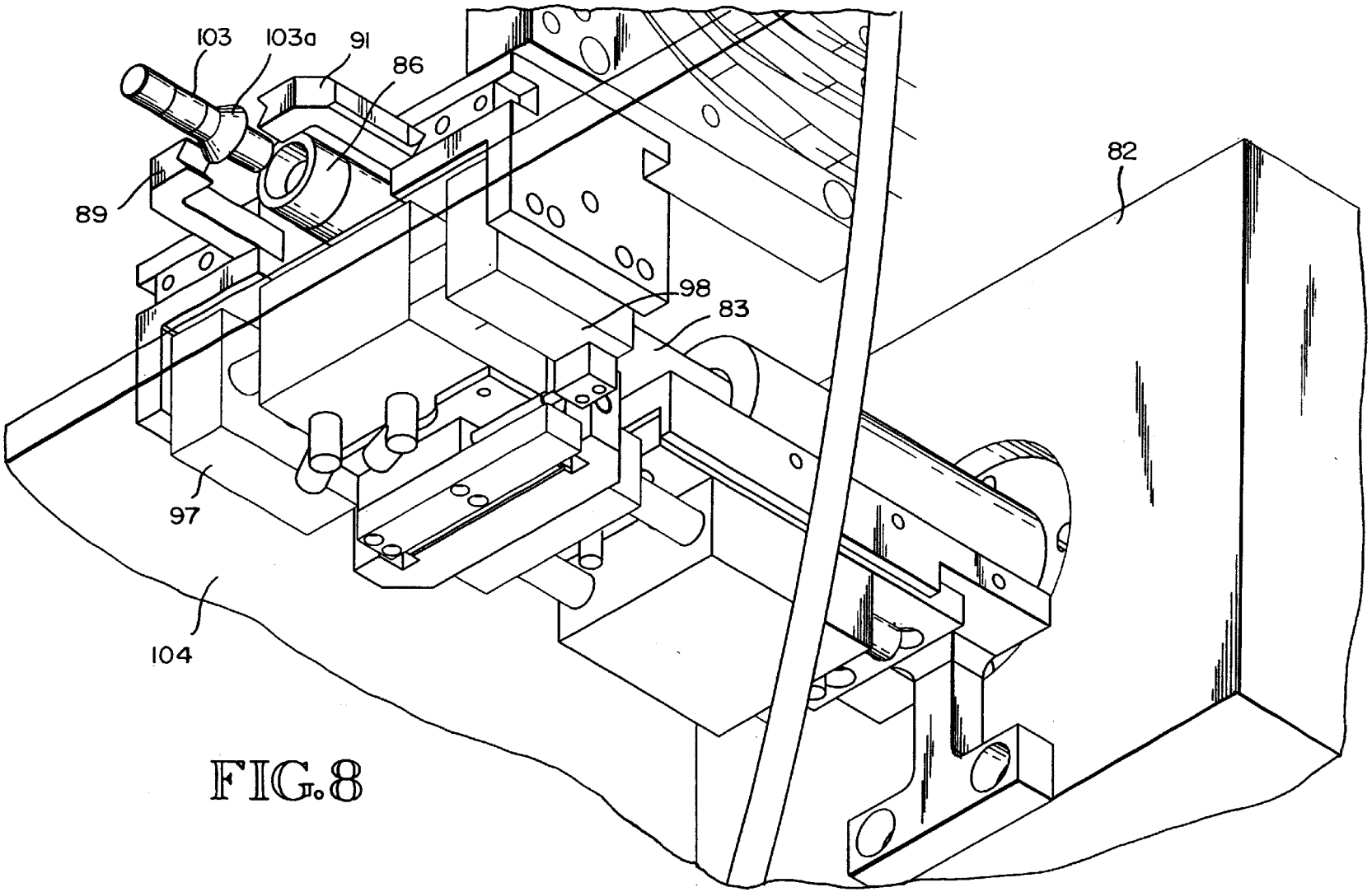
Figure 9:
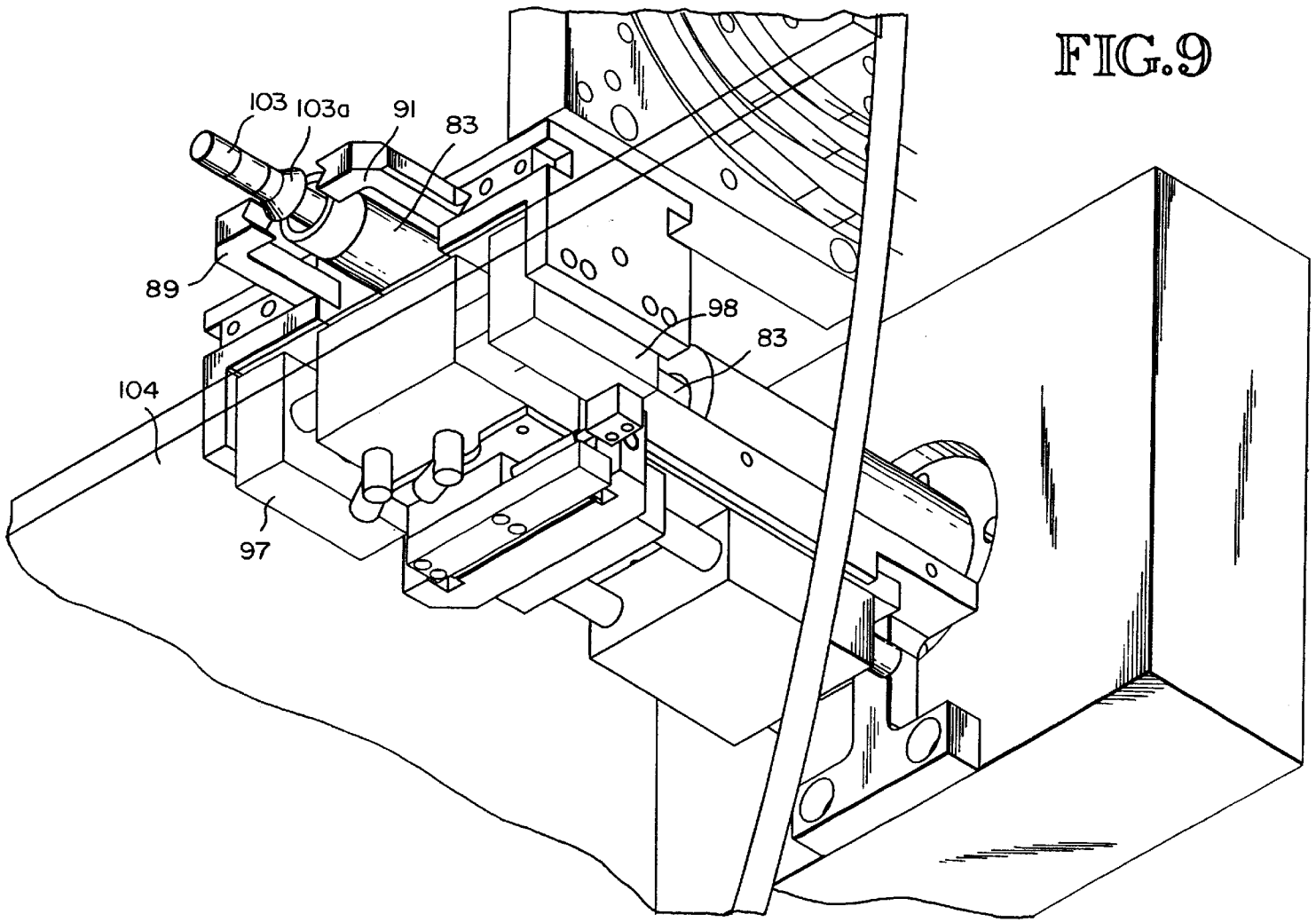
Figure 10A:
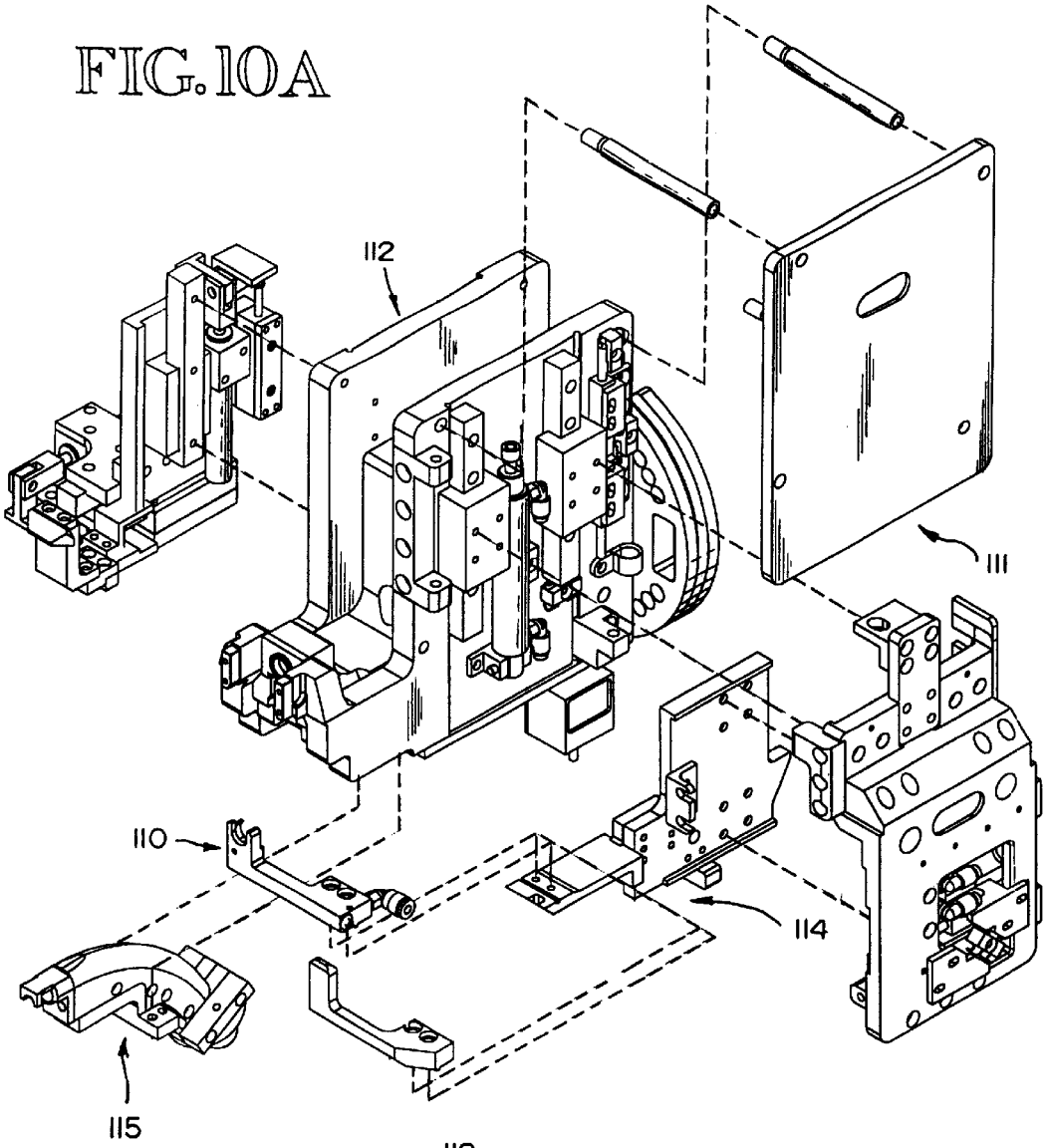
FIGS. 10A and 10B are exploded and assembled views of a complete collar insertion and swaging system, including the collar gripping system of the present invention.
Figure 10B:
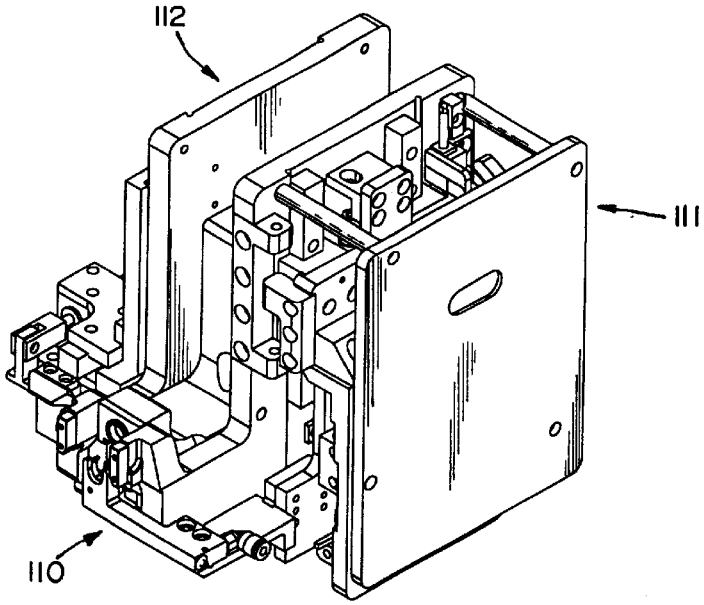

If the gripping fingers move fully forward, indicating that the rivet is fully inserted in the opening, then the fingers are released by a specific control command from the microprocessor and then move apart to allow RAM 83 to pass through as shown in FIG. 8. The ram is now moved up to contact the head of the rivet, as shown in FIG. 9. Once on the rivet, the EMR can be discharged, with the rivet being driven with great force, resulting in upset of the rivet and completion of the riveting operation. The ram and the gripping mechanism are then removed to their initial position. The process is then repeated for the next rivet.

FIGS. 10–15 show the collar gripping system of the present invention. The collar gripping assembly 110 is shown as a part of the complete collar swaging assembly 111 in FIGS. 10A and 10B. The collar swaging assembly moves a lockbolt into an opening in the workpiece, moves a collar into position on the tail of the lockbolt, and then swages the collar onto the lockbolt. The collar gripping assembly portion 110, described in detail herein, is secured to a central fork assembly 112, to which is attached a collar transfer assembly 114, which accomplishes both horizontal and vertical movement of the collar onto the tail of the lockbolt. In initial operation, collar feed assembly 115 shown in FIGS. 10A; 10B moves a collar from a nearby storage bin (not shown) to gripping assembly 110.

Figure 11:
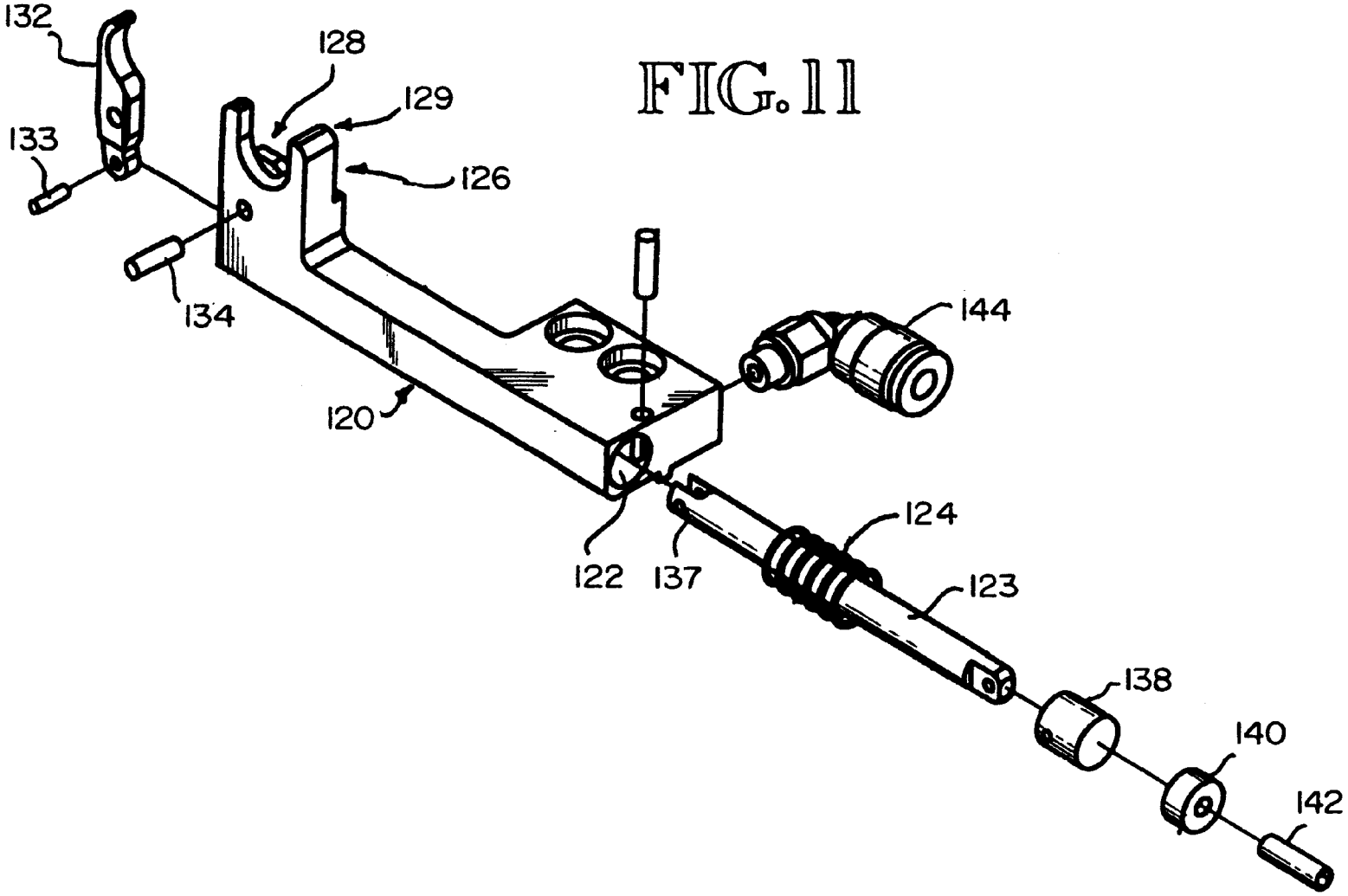
FIG. 11 is an exploded view of the collar gripping system of the present invention.
Figure 12B:
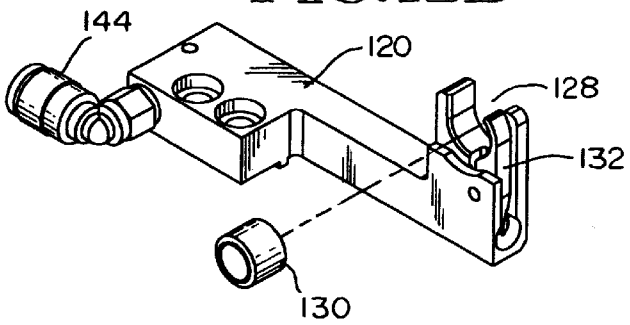
FIGS. 12A and 12B, 13A and 13B and 14A and 14B are cross-sectional elevational and-perspective views of sequential steps of the collar gripping system of the present invention.

The gripping assembly 110 is shown in exploded view in FIG. 11. Gripping assembly 110 includes a gripper body 120, having an interior opening 122 which extends approximately the length of the body. A connecting rod 123 is positioned in opening 122 with a spring member 124 arranged around the rod, tending to maintain the rod in a given position.

At one end of gripper body 120 is a collar receiving portion 126, which extends away from body 120 at a right angle thereto. The collar receiving portion 126 includes a U-shaped opening 128 at an upper end 129 thereof. Opening 128 is designed to receive a collar. Receiving portion 126 may include a rear stop for the collar. A gripping finger 132 is pivotally mounted about a pivot pin 134 at one side of the collar receiving portion 126. Gripping finger 132 is curved to fit against the exterior surface of a collar. The lower end 136 of gripping finger 132 is pivotally secured by a pin 133 to the distal end 137 of elongated rod 132. As rod 123 is moved back and forth, gripping finger 132 moves about pivot pin 134, so that the upper end portion thereof moves into and out of U-shaped opening 128.

At the other end of connecting rod 123 is a piston element 138, a piston stop 140 and a set-screw 142. Compressed air is fed into gripper body 120, at one end 143 thereof adjacent piston 138 in opening 122, via an elbow connection 144. The control of compressed air is accomplished by a control command from the system microprocessor.

FIGS. 12–15 show the operation of the collar gripping system. In a first step, shown in FIGS. 12A–12B, a collar 130 is fed into the U-shaped opening 128 in receiving portion 126 of gripper body 120, the U-shaped opening being large enough to readily accept the collar. The feeding of the collar is accomplished by compressed air, the collar being blown along a feed tube (not shown) into the U-shaped opening 128, the gripping finger 132 being at that point in an open position, away from the receiving portion, maintained in that position by spring 124 operating on rod 123. With the gripping finger 132 away from opening 128, a collar is easily moved into opening 128.

Figure 13B:
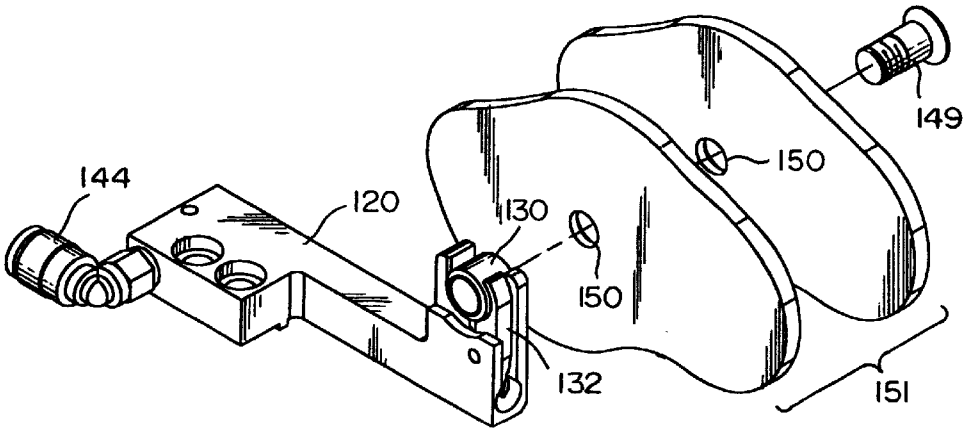
Figure 12A:
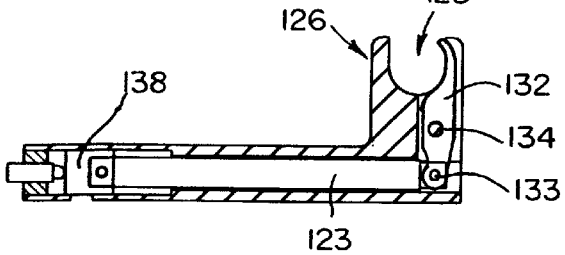
Figure 13A:
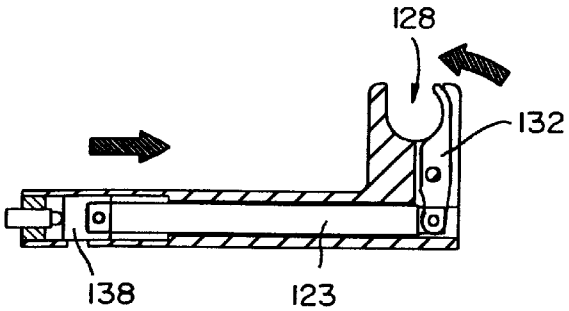

As the collar moves along the feed tube, it passes a ring sensor (not shown) which sends a signal to the system microprocessor. After a preselected time following the signal, during which the collar reaches the gripping assembly, the microprocessor provides a control command to a solenoid which controls the flow of compressed air into the gripper body through elbow connection 144. The compressed air operates against piston 138, forcing the rod 123 against the bias of spring 124, in turn resulting in the pivoting of gripping finger 132 about pin 134, such that the upper portion of the gripping finger moves into the U-shaped opening, in effect securely gripping the collar positioned therein tightly. This is shown in FIGS. 13A and 13B.

Thus, the gripping finger is normally biased in an open position. The gripping finger is then moved positively into secure, strong contact with collar 130 after the collar has been positioned in opening 128. The secure, positive gripping action is achieved quickly and easily by means of the compressed air acting on rod 123, which in turn controls the position of gripping finger 132.

The gripping assembly with the collar is now moved both vertically and horizontally to fit the collar over the tail of a lockbolt 149, which has been previously inserted through openings 150 in the workpiece 151, which comprises two or more sheets of material being joined together.

Figure 14B:
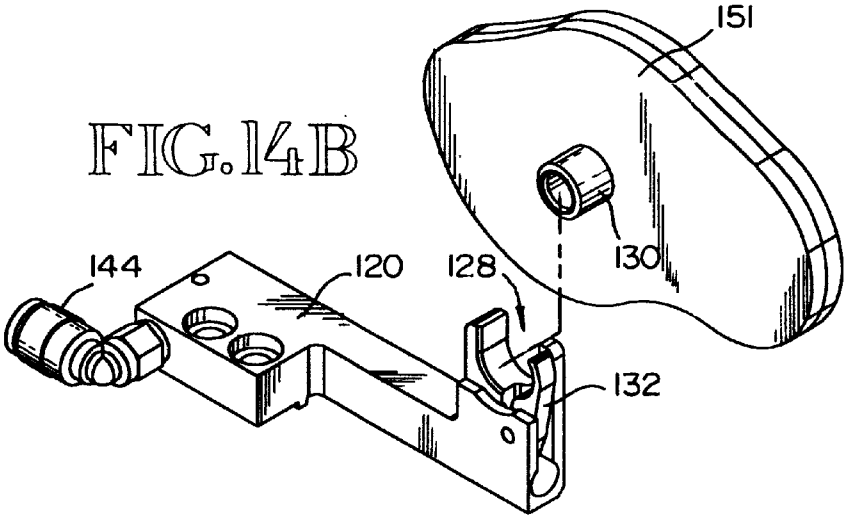
Figure 14A:
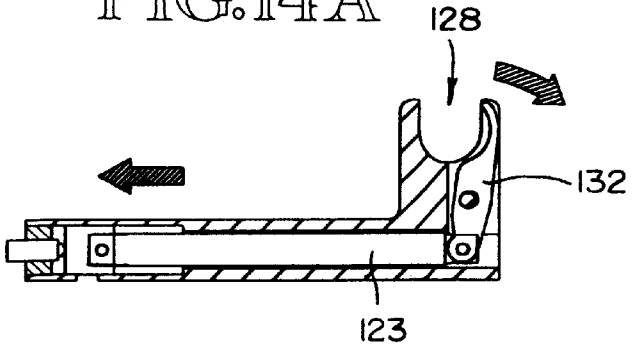

When the collar is fully on the lockbolt, the compressed air is shut off and the spring 124 returns the rod 123 to its original position, with the gripper finger 132 also moving to its original position away from opening 128, such that the gripper finger 132 releases the collar. This is shown in FIGS. 14A and 14B. The gripping assembly 110 is then moved away from the workpiece, so that the collar 130 can be swaged onto the lockbolt, in conventional fashion.

Figure 15:
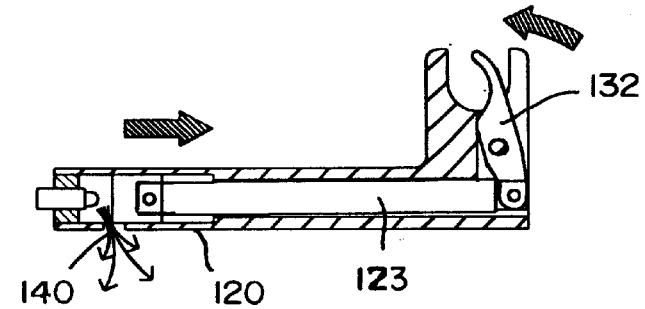
FIG. 15 is an elevational cross-sectional view of the gripping element of the present invention activated with no collar present.

The gripping assembly 110, under computer control, thus receives the collar, grips the collar, moves the collar onto the lockbolt, and then releases the collar. In the event that there is no collar in the gripping assembly when the gripping assembly is activated by compressed air, the connecting rod and finger 132 will move to their extreme position as shown in FIG. 15. This will uncover an opening 140 in the bottom of the gripper body 120, allowing compressed air to escape therefrom. The escape of compressed air from opening 140 is sensed, and a signal sent to the operator so that the operation can determine the reason for absence of a collar.

Hence, systems which include computer control, operating at precise times, have been disclosed which positively grip the rivet or the collar, insert the rivet into an opening in the workpiece or move a collar onto a lockbolt, and then release the rivet/collar, again by means of a control signal. The gripping member move easily from a position relatively away from the rivet or collar, to another position in which the rivet/collar is gripped strongly and securely, and then back again, without the need for a separate motor.

Although a preferred embodiment of the invention has been disclosed herein for illustration, it should be understood that various changes, modifications and substitutions may be incorporated in such embodiment without departing from the spirit of the invention, which is defined by the claims as follows.

What is claimed is:

1. A system for gripping a rivet element during installation thereof in an assembly, comprising:

an actuator assembly;

means for gripping a rivet mounted on the actuator assembly;

a ram member, also mounted on the actuator assembly, for performing riveting operations on a rivet which has been inserted into an opening in a workpiece, wherein movement of the actuator assembly results in movement of the gripping means and the ram member;

means for moving a rivet from a storage location to an initial position, wherein the gripping means is operated to grip the rivet in its initial position in response to a signal command, the gripping means including two opposed gripping elements which move from first positions relatively away from the rivet to second, closed positions positively gripping the rivet;

means for moving the actuator assembly so as to move the gripped rivet into the opening in the workpiece, the ram member moving along with the actuator assembly; and means for releasing the gripping means as the rivet is moved into the workpiece by the actuator assembly, following insertion of a forward end of the rivet into the opening but prior to the gripping means being pinched against the workpiece, wherein the opposed elements of the gripping means move back to their first position when the gripping means is released, so that the ram member can then be advanced to upset the rivet.

2. A system of claim 1, including means for determining the presence of a rivet at said initial position following operation of the gripping means but prior to the rivet being moved into the opening in the workpiece.

3. A system of claim 2, wherein said means for determining includes means for ascertaining whether the rivet meets preselected size specifications.

4. A system of claim 3, including means for discarding the gripped rivet if it does not satisfy said preselected size specifications.

5. A system of claim 4, wherein the gripping means includes means for moving the two opposed gripping elements transversely toward one another in synchronization to grip the rivet.

6. A system of claim 5, wherein the ascertaining means includes a sensing means which is responsive to the distance between the gripping elements when the gripping elements move transversely from their open position to their closed position.

7. A system of claim 6, wherein the sensing means is a linear potentiometer, which moves in accordance with movement of the gripping elements.

8. A system of claim 6, wherein the sensing means is an LVDT which moves in accordance with movement of the gripping elements.

9. A system of claim 1, wherein said means for gripping the rivet is a fluid pressure system.

10. A system of claim 9, wherein said fluid pressure system is compressed air.

11. A system of claim 1, including means for maintaining a gap between the rivet and the ram means during moving of the rivet into the opening.

12. A system of claim 11, wherein the gap is maintained by a low force which can be overcome by the rivet encountering resistance in its moving into the opening, the system further including means for determining the position of the rivet in the opening when the gap between the rivet and the ram begins to close.

13. A system of claim 12, including means for indicating an error condition when the gap begins to close before the rivet is fully inserted into the opening.

14. A system of claim 12, wherein the low force is provided by air pressure.

15. A system of claim 12, wherein closure of the gap is determined by a proximity sensor.

16. A system of claim 12, wherein closure of the gap is determined by a Hall effect sensor.

* * * * *